US006738489B2

(12) United States Patent
Chung et al.

(10) Patent No.: US 6,738,489 B2
(45) **Date of Patent: *May 18, 2004**

(54) VIBRATION SPEAKER

(75) Inventors: Seuk Hwan Chung, Suwon-Shi (KR); Seung Hee Suh, Suwon-Shi (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 136 days.

This patent is subject to a terminal disclaimer.

(21) Appl. No.: 09/846,709

(22) Filed: May 1, 2001

(65) Prior Publication Data

US 2002/0061115 A1 May 23, 2002

(30) Foreign Application Priority Data

Nov. 20, 2000 (KR) ..... 2000-68976

(51) Int. Cl.[7] ..... H04R 25/00
(52) U.S. Cl. ..... 381/396; 381/431; 340/407.1
(58) Field of Search ..... 340/7.6, 384.1, 340/388.1, 407.1; 381/151, 152, 396, 398, 400, 401, 402, 412, 413, 431

(56) References Cited

U.S. PATENT DOCUMENTS 5,894,263 A * 4/1999 Shimakawa et al. ..... 381/396
6,487,300 B1 * 11/2002 Lee et al. ..... 381/396

* cited by examiner

*Primary Examiner*—Suhan Ni
(74) *Attorney, Agent, or Firm*—Darby & Darby

(57) ABSTRACT

A vibration speaker is configured to selectively supply an input current in accordance with the frequency of the input current in response to an incoming call, thereby allowing the incoming call to be recognized by sound or vibrations using a single element. The vibration speaker includes a hollow housing with open ends with a vibrating plate attached at one end a shield plate at the other end. A yoke is fixedly mounted to an inner peripheral surface of the housing by plate springs, and a vertically polarized magnet is mounted on the yoke. A voice coil having an upper end fixed to the vibrating plate has a lower end arranged adjacent to the magnet, and a vibration coil is mounted on the shield plate so as to face the magnet. Damping means at the inner peripheral surface of the housing provide damping to the plate springs, thereby reducing the amplitude of vibrations.

2 Claims, 5 Drawing Sheets

VIBRATION SPEAKER

BACKGROUND OF THE INVENTION

1. Field of the Invention

The present invention relates a vibration speaker installed in a communication appliance such as a cellular phone and adapted to conduct both the function for generating sound and the function for generating vibrations. More particularly, the present invention relates to a vibration speaker capable of applying upward and downward damping forces to a vibrating body, thereby reducing a variation in the amplitude of vibrations depending on a variation in frequency to obtain an improvement in vibration characteristics.

2. Description of the Related Art

Generally, a speaker is a sound generating device for outputting an audible sound corresponding to an audio signal electrically or electronically received or a bell or melody previously inputted.

Typically, such a speaker is connected to an audio appliance or amplifier so that it serves as a large-size sound generating means adapted to greatly amplify the amplitude of sound. Alternatively, speakers are widely used which have a greatly reduced size so that they are used as miniature sound generating means.

In particular, speakers applied to miniature communication appliances such as cellular phones or pagers have a greatly reduced size. Such speakers are called "micro speakers"

The current tendency of such micro speakers is toward smaller sizes because communication appliances such as cellular phones are currently intended to have a reduced size or thickness.

FIG. 1 is a sectional view illustrating a conventional micro speaker mainly used in portable communication appliances. As shown in FIG. 1, the conventional micro speaker includes a housing 100 defined with a space therein. A magnet 110 and a voice coil 120 are arranged in the housing 100. The micro speaker also includes a vibrating plate 130 for generating a sound.

In the micro speaker having the above mentioned configuration, when a high frequency current supplied from an external current source is applied to the voice coil 120 via a lead 101, a magnetic field is established in accordance with a cooperation between the voice coil 120 and the magnet 110, thereby causing the voice coil 120 to move vertically. As a result, the vibrating plate 130, which is attached to one end of the voice coil 120, generates a sound while finely vibrating.

The high frequency current applied to the voice coil 120 via the lead 101 is AC. Accordingly, when the magnetic field generated by the voice coil 120 varying in direction in accordance with the direction of the current applied to the voice coil 120 is rendered to correspond to the magnetic field formed by the magnet 110, a repulsion force is exerted between the magnet 110 and the voice coil 120, so that the magnet 110 and the voice coil 120 tend to be moved away from each other. As a result, the voice coil 120 is upwardly moved away from the magnet 110.

On the other hand, when the magnetic field generated by the voice coil 120 has a direction reverse to that of the magnetic field formed by the magnet 110, an attraction force is exerted between the magnet 110 and the voice coil 120, so that the magnet 110 and the voice coil 120 tend to be moved toward each other. As a result, the voice coil 120 is downwardly moved toward the magnet 110.

Thus, the voice coil 120 moves upwardly and downwardly in accordance with a change in direction of the magnetic field generated by the voice coil 120. By virtue of the alternating upward and downward movements of the voice coil 120, the vibrating plate 130 attached to the voice coil 120 vibrates upwardly and downwardly. As the vibrations of the vibrating plate 120 is externally emitted, a sound is generated. Thus, the sound generating function is carried out.

Meanwhile, the portable communication appliance also includes a vibrating means adapted to allow the user to recognize a receiving call by vibrations other than sound.

For such a vibrating means, a vibration motor has been mainly used. Recently, a vibration speaker has been developed which is configured by adding a vibrating function to a speaker having a simple sound generating function.

FIG. 2 is a sectional view illustrating a conventional vibration speaker. As shown in FIG. 2, the vibration speaker has a configuration including a voice coil adapted to generate sound when it receives a high frequency current, and a vibration coil adapted to generate vibrations when it receives a low frequency current.

In detail, this vibration speaker includes a housing 100 adapted to form a casing and defined with a space having a desired size. A yoke 105 is arranged at the central portion of the space defined in the housing 100.

A weight 140 fixed to outer surface of the yoke 105 is elastically supported by a pair of vertically spaced plate springs 150 and 155 each fixedly mounted to the inner peripheral surface of the housing at one end thereof. The plate springs 150 and 155 are also mounted to the upper and lower portions of the yoke 105 to support the yoke 105, respectively.

The upper spring 150 is firmly fitted, at its outer peripheral edge, in a holding groove 100*a* provided at the upper portion of the inner peripheral surface of the housing 100. The outer peripheral edge of the lower spring 155 is in contact with a step of the housing 100 at its upper surface. The step is formed at the lower portion of the inner peripheral surface of the housing 100. Under the condition in which the lower spring 155 is in contact with the step, the lower spring 155 is bonded to the housing 100 using an adhesive 100*b* applied between the inner peripheral surface of the housing 100 and the lower surface of the lower spring 155.

A magnet 110 is attached to the central portion of the yoke 105. Beneath the magnet 110, a vibration coil 115 is attached to the upper surface of a lower plate 102 attached to the lower end of the housing 100.

A vibrating plate 130 adapted to generate sound is mounted to the upper end of the housing 100. A voice coil 120 extends downwardly from the vibrating plate 130 in such a fashion that it surrounds the magnet 110.

In order to obtain an increased amplitude of vibrations in the vibration speaker having the above mentioned configuration, a weight 140, which is a mass body, is arranged in the space defined between the plate springs 150 and 155.

In the conventional vibration speaker having the above mentioned configuration, when a high frequency signal is applied to the voice coil 120, the vibrating plate 130 vibrates finely by virtue of electromagnetic forces generated between the voice coil 120 and the magnet 110, thereby generating sound. This sound is used as a speaker sound.

When a low frequency signal is applied to the vibration coil 115, the vibrating body moves upwardly and downwardly by virtue of electromagnetic forces generated between the vibration coil 115 and the magnet 110. This upward and downward movements are transmitted to the housing 100 via the plate springs. Thus, a desired vibration function is carried out.

In the above mentioned conventional vibration speaker, the vibrating body, which is composed of the yoke 105, the magnet 110, and the weight 140, is upwardly and downwardly moved in accordance with a vibration excitement at a desired frequency using the resonant frequency of the vibrating body. Thus, vibrations are generated.

However, this conventional vibration speaker has a disadvantage in that there may be a variation in the amplitude of vibrations due to an assembling dispersion of the yoke 105, magnet 110, and weight 140 included in the vibrating body, and that there is a deviation between the designed resonant frequency of the vibrating body and the actual resonant frequency of the vibrating body because a variation in the amplitude of vibrations occurs depending on the dimension dispersion of each element included in the vibration speaker.

Referring to FIG. 3, it can be found that the gradient of peak at resonance is appeared in a large scale. As mentioned above with reference to FIG. 2, FIG. 4 shows that there is a touching phenomenon between a weight and a lower plate at region of resonant frequency during oscillation of the weight. Therefore vibration characteristics of the conventional art is not good.

For example, where the mass of the vibrating body is varied by 0.03 g, the resonant frequency is shifted by about 1 Hz. When the resonant frequency is shifted by 1 to 2 Hz, the amplitude of vibrations is considerably reduced. For this reason, there is a problem in that it is difficult to induce desired vibration characteristics.

The resonant frequency may be expressed by the following equation:

$$Fn=1/(2\pi)\sqrt{(k/m)}$$

where, k represents a spring constant, and m represents a mass.

Referring to the above equation, it can be found that the resonant frequency Fn is varied, depending on a variation in the mass m.

Furthermore, the effective space allowing the vibrating body to move upwardly and downwardly is considerably restricted in the above mentioned convention vibration speaker because the speaker has a thin structure. For this reason, the vibrating body may come into contact with the upper and lower surfaces of the housing 100 during its upward and downward movements when the amplitude of the vibrating body exceeds a predetermined level due to a variation in the weight of the vibrating body. As a result, there may be a degradation in vibration characteristics. In addition, noise may be generated. There may also be a reduction in the life of the product.

As depicted in the graphs, the maximum effective amplitude of vibrations should be maintained at about 2.5 G, taking into the consideration the restricted effective space in which the vibrating body moves upwardly and downwardly. In the conventional vibration speaker, however, the maximum effective amplitude of vibrations reaches 3.5 G. As a result, the vibrating body is struck against the upper and lower surfaces of the shield plate 102, thereby generating noise. Due to frequent striking of the vibrating body, the durability of the speaker is degraded.

Moreover, the frequency band of vibrations practically usable corresponds to the frequency range in which the vibrating body does not come into contact with the shield plate 102. As a result, the effective frequency band of vibrations is reduced toward the left or right range from the resonant frequency of 182 Hz. This means that it is impossible to obtain a desired vibration function. Also, there is a disadvantage in that the touch of vibrations is bad.

SUMMARY OF THE INVENTION

Therefore, an object of the invention is to provide a vibration speaker capable of applying a damping force to a plate spring adapted to support a vibrating body, thereby reducing a variation in the amplitude of vibrations depending on a variation in frequency to obtain stable vibration characteristics.

Another object of the invention is to provide a vibration speaker capable of preventing elements included in the vibration speaker from being struck against one another during the execution of a desired vibration function, thereby achieving an improvement in durability to extend the lift of the vibration speaker.

In accordance with the present invention, these objects are accomplished by providing a vibration speaker comprising: a housing having a hollow cylindrical structure opened at both ends thereof, the housing being attached, at one end thereof, with a vibrating plate adapted to generate sound and, at the other end thereof, with a shied plate adapted to shield the other end of the housing; a yoke centrally arranged in the interior of the housing and fixedly mounted to an inner peripheral surface of the housing by plate springs spaced apart from each other by a desired distance; a magnet attached to an upper end of the yoke to have N and S poles vertically aligned together, the magnet constituting a magnetic circuit; a voice coil having an upper end fixed to the vibrating plate, and a lower end arranged adjacent to the magnet; a vibration coil attached to one surface of the shield plate while facing the magnet; and damping means arranged at the inner peripheral surface of the housing and adapted to apply a damping property to the plate springs, thereby reducing a variation in the amplitude of vibrations transmitted to the plate springs.

The damping means may comprise a rubber member composed of a rubber material to respective outer peripheral ends of the plate springs.

The damping means may comprise soft bonds applied in a desired amount to respective outer peripheral ends of the plate spring fixedly mounted to the inner peripheral surface of the housing.

The vibration speaker may further comprises a weight attached to an outer peripheral surface of the yoke, the weight having a desired mass.

BRIEF DESCRIPTION OF THE DRAWINGS

The above objects, and other features and advantages of the present invention will become more apparent after a reading of the following detailed description when taken in conjunction with the drawings, in which.

DESCRIPTION OF THE PREFERRED EMBODIMENTS

The present invention provides a vibration speaker configured to apply upward and downward damping forces to a vibrating body, thereby reducing a variation in the amplitude of vibrations depending on a variation in frequency to obtain stable vibration characteristics.

Figure 1:
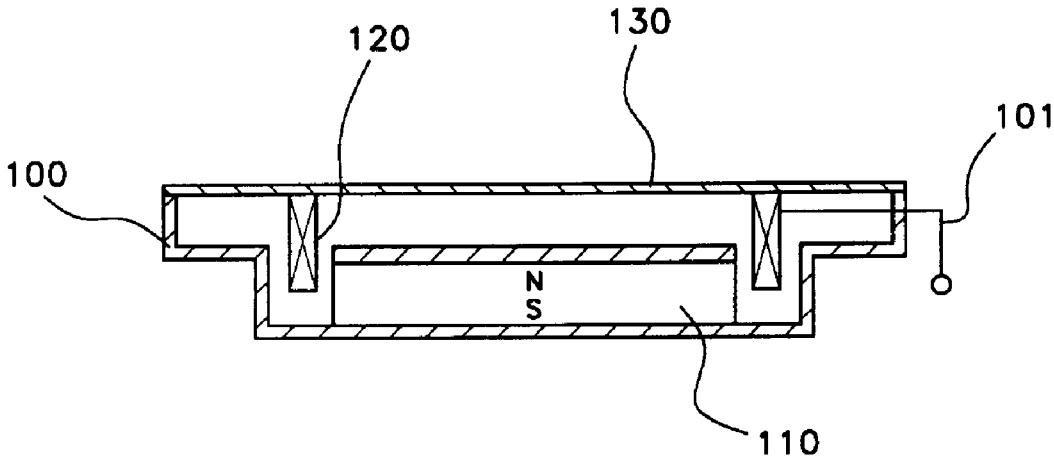
FIG. 1 (CONVENTIONAL ART)
FIG. 1 is a sectional view illustrating a conventional micro speaker mainly used in portable communication appliances.
Figure 2:
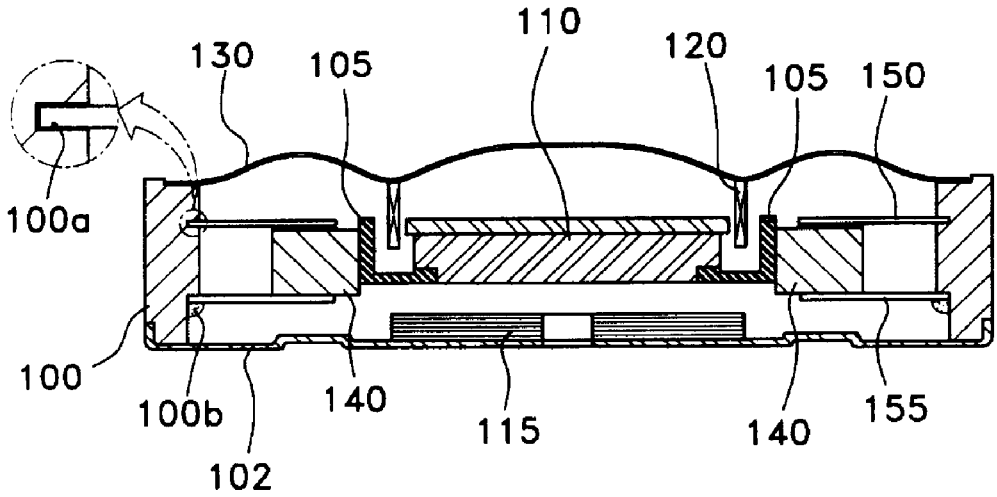
FIG. 2 (CONVENTIONAL ART)
FIG. 2 is a sectional view illustrating a conventional vibration speaker.
Figure 3:
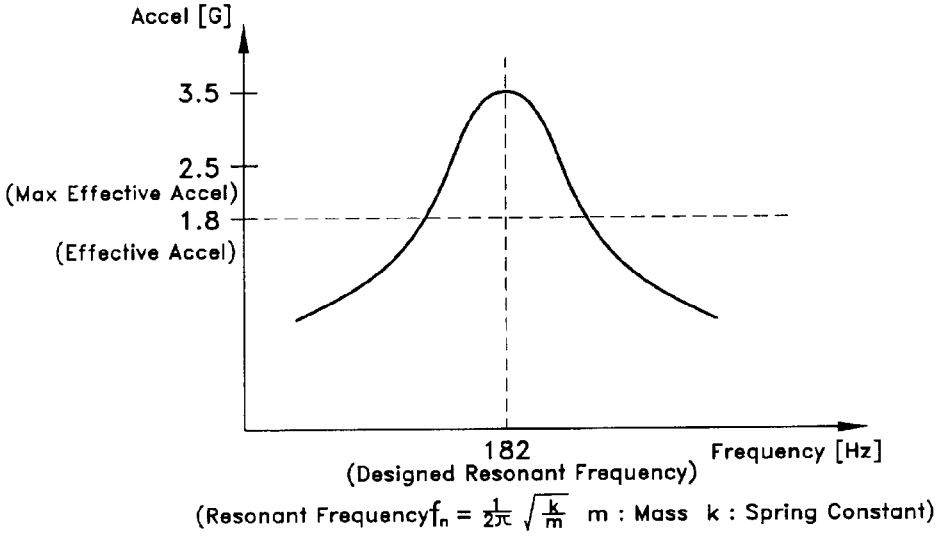
FIG. 3 (CONVENTIONAL ART)
FIG. 3 is a graph depicting the relation between the resonant frequency and vibration amplitude in the conventional vibration speaker.
Figure 4:
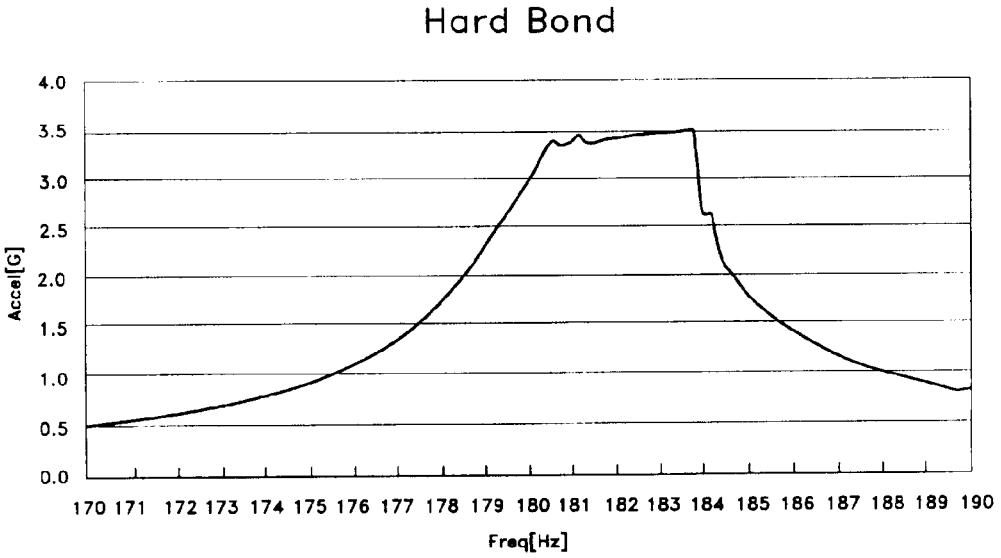
FIG. 4 (CONVENTIONAL ART)
FIG. 4 is a graph depicting the vibration characteristics of the conventional vibration speaker.
Figure 5:
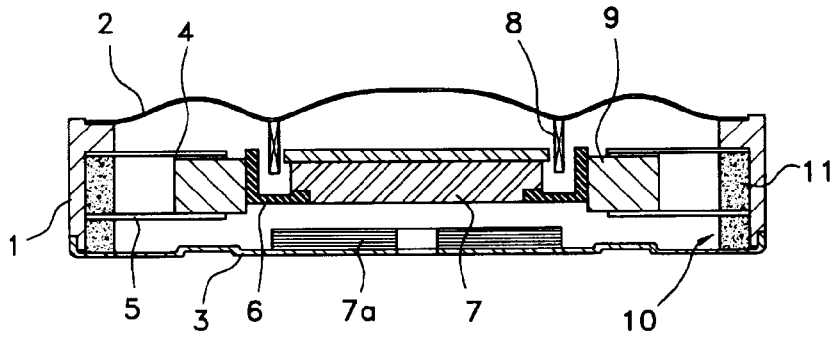
FIG. 5 is a sectional view illustrating a vibration speaker according to an embodiment of the present invention.

FIG. 5 is a sectional view illustrating a vibration speaker according to the present invention.

As shown in FIG. 5, the vibration speaker includes a cylindrical housing 1 defined with a space therein. In the housing 1, a vibrating plate 2, a voice coil 8 adapted to generate sound, and a vibrating body, and plate springs 4 and 5 are installed.

The housing 1 is a casing having a hollow cylindrical structure. The vibrating plate 2 is mounted to an opened one end of the housing 1. The opened other end of the housing 1 is shield by a shield plate 3.

In order to allow a vibrating sound to be externally emitted from the interior of the housing 1, at least one sound emit hole (not shown) is provided at the shield plate 3. The position of the sound emit hole is not limited to the shield plate 3 of the housing 1. The sound emit hole may be formed at any position.

The vibrating plate 2 is a thin plate member adapted to generate sound while vibrating upwardly and downwardly. The vibrating plate 2 is mounted to the upper end of the housing 1 at its outer peripheral edge.

The voice coil 8 is configured by winding a coil in the form of a cylindrical structure. This voice coil 8 includes a bobbin (not shown), and a coil wound around the bobbin. The bobbin is attached to the lower surface of the vibrating plate 2 at its upper end in such a fashion that its lower end is arranged near a magnet 7 arranged in the housing 1.

When a high frequency current is applied to the voice coil 8, this voice coil 8 vibrates the vibrating plate 2 in cooperation with the magnet 7, thereby causing the vibrating plate 2 to generate sound.

The vibrating body includes a yoke 6 and weight 9, in addition to the magnet 7. The yoke 6 is arranged at the central portion of the space defined in the housing 1. The magnet 7 is attached to the upper surface of the yoke 6. Thus, a magnetic circuit is formed.

In order to achieve an increase in the amplitude of vibrations, the weight 9, which has a desired mass, is attached to the yoke 6. Typically, the weight 9 has a ring shape so that it is arranged around the periphery of the yoke 6. In particular, the weight 9 is preferably made of a material not influenced by magnetic fluxes.

The vibrating body is supported by the plate springs 4 and 5 fixed to the outer peripheral surface of the yoke 6, so that it is elastically supported by the housing 1.

The plate springs 4 and 5 are vertically spaced from each other so that they are fixed to the upper and lower portions of the outer peripheral surface of the yoke 6, respectively. The plate springs 4 and 5 are also fixed to the inner peripheral surface of the housing 1. Accordingly, the plate springs 4 and 5 can serve to allow the vibrating body composed of the yoke 6, magnet 7, and weight 9 to move in upward and downward directions in an elastic fashion.

The vibration speaker also includes a vibration coil 7*a* attached to the shield plate 3 of the housing 1. When a low frequency current is applied to the vibration coil 7*a,* a desired vibration function is conducted by virtue of electromagnetic forces generated between the vibration coil 7*a* and the magnet 7.

The above mentioned configurations of the vibration speaker are similar to those of the conventional vibration speaker. The present invention has a feature in that the vibration speaker includes a damping means 10 for gently attenuating a variation in the amplitude of vibrations resulting from a dimension dispersion of the vibrating body.

As mentioned above, the vibrating body is composed of the yoke 6, magnet 7, and weight 9. This vibrating body is elastically supported by a pair of plate springs 4 and 6, which are elastic members, in the interior of the housing 1.

The plate springs 4 and 5 are supported by a damping means 10 in order to attenuate the amplitude of vibrations transmitted to the vibration body. As shown in FIG. 5, the damping means 10 comprises a rubber member 11 attached to the inner peripheral surface of the housing 1 and adapted to support the plate springs 4 and 5.

The rubber member 11 serving as the damping means 10 is made of a rubber material having a superior damping property. The rubber member 11 is bonded to the inner peripheral surface of the housing 1 by means of an adhesive under the condition in which it is in close contact with the housing 1.

In the illustrated case, the rubber member 11 is divided into a plurality of pieces which are sequentially laminated in a vertical direction in the housing 1 while supporting the outer peripheral ends of the plate springs 4 and 5.

The rubber member 11 may provide a variety of supports for the plate springs 4 and 5. In the case of FIG. 5, the upper plate spring 4 is in contact with the housing 1. In this case, one piece of the rubber member 11 is interposed between the upper plate spring 4. Another piece of the rubber member 11 is arranged beneath the lower plate spring 5.

Accordingly, the upper spring 4 is supported by the rubber member 11 in a limited fashion, that is, only at its lower surface. On the other hand, the lower spring 5 is supported by the rubber member 11 at both surfaces thereof.

Figure 6:
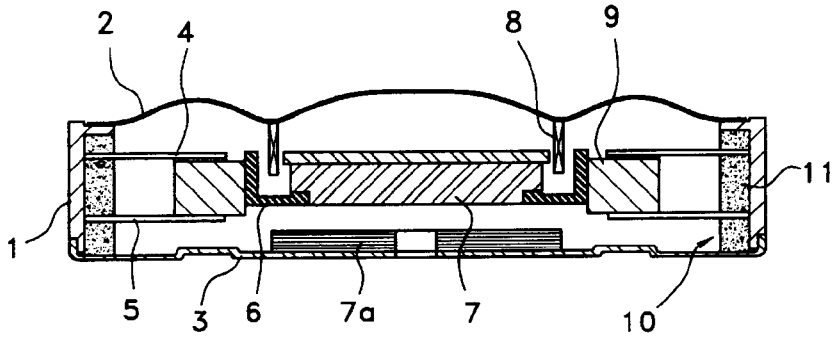
FIG. 6 and FIG. 7 are sectional views illustrating a vibration speaker according to another embodiment of the present invention.
Figure 7:
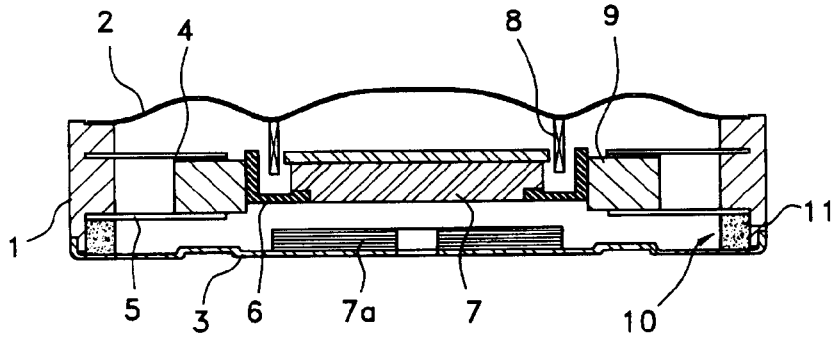

Meanwhile, said rubber member 11 can be constructed, as shown in FIG. 6 and FIG. 7.

That is, FIG. 6 shows that the rubber member 11 is divided into three pieces to be sequentially laminated and one piece of the rubber member 11 is arranged on the upper surface of the upper plate spring 4. Another piece of the rubber member 11 is interposed between the upper plate spring 4 and lower plate spring 5. The remaining piece of the rubber member 11 is arranged beneath the lower plate spring 5.

In this case, accordingly, each of the plate springs 4 and 5 is supported by the rubber member 11 at both surfaces thereof.

Meanwhile, FIG. 7 illustrates another embodiment of the present invention. The upper plate spring 4 is inserted into the groove(not shown) within the inner peripheral surface of the housing 1 and fixed, as shown in FIG. 7. Also the lower plate spring 5 is placed below the upper plate spring.

Wherein, the upper surface of the lower plate spring 5 is contacted on the lower surface of the housing 1 that is fixing the upper plate spring 4 and the rubber member 11 is placed below said lower plate spring 5.

Therefore, as shown in FIG. 7, the rubber member 11 has the structure for supporting the lower surface of the lower plate spring 5.

As apparent from the above description, a desired damping force is applied to the plate springs 4 and 5 supporting the vibrating body because the rubber member 11 is interposed among the housing 1, the plate spring 4, and the plate spring 5, as shown in FIGS. 5–7.

Although the rubber member 11 has been described as being divided into a plurality of pieces to be sequentially laminated to support the plate springs 4 and 5, it is not limited to such a structure. The rubber member 11 may have diverse structure to support the plate springs 4 and 5.

For example, although not shown, the rubber member 11 may have an integral structure. In this case, a plurality of vertically spaced grooves are formed at the inner peripheral surface of the rubber member 11 so that the plate springs 4 and 5 are fixed in such a fashion that their outer peripheral ends are fitted in the grooves, respectively. Alternatively, the upper plate spring 4 is interposed between the step of the housing 1 and the upper surface of the rubber member 11 at its outer peripheral end. In this case, a groove is formed at the lower portion of the inner peripheral surface of the rubber member 11 so that the lower plate spring 5 is fixed in such a fashion that its outer peripheral end is fitted in the groove.

Also there is a method of fixing lower plate spring 5 only, i.e., the rubber member 11 is inserted to the lower part of lower plate spring 5.

Although the damping means 10 has been described as comprising the rubber member 11 having the form of a sold body, it may be implemented using diverse materials in so far as it can apply a desired damping force to the plate springs 4 and 5.

Figure 8:
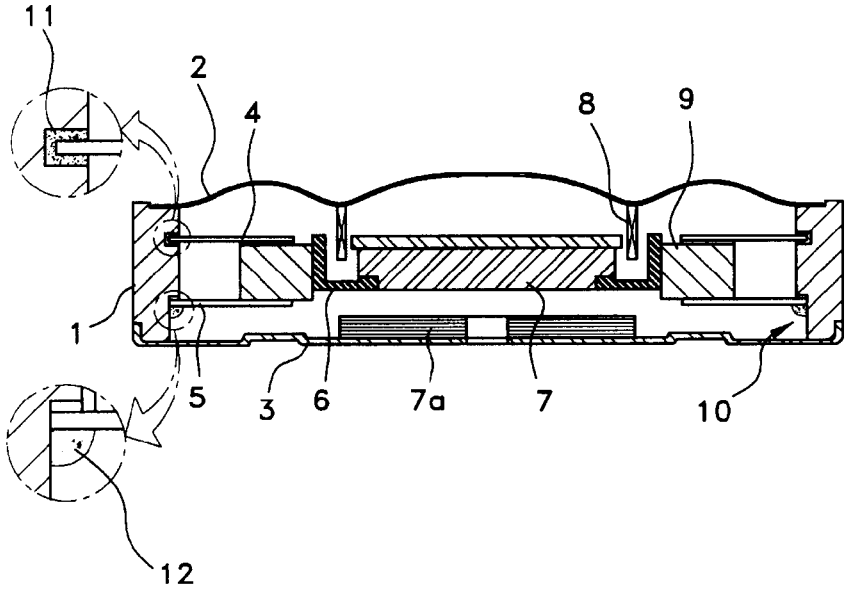
FIG. 8 is a sectional view illustrating a vibration speaker according to another embodiment of the present invention.

FIG. 8 illustrates another embodiment of the damping means used in the vibration speaker according to the present invention. As shown in FIG. 8, the plate springs 4 and 5 are fixed to the housing in the same fashion as the conventional case. In accordance with this embodiment, however, the upper and lower plate spring 5 are supported by soft bonds serving as the damping means 10 so that they are provided with a desired damping property.

That is, a soft bond 12 is applied in a desired amount between the inner peripheral surface of the housing and the outer peripheral end of the lower plate spring 5.

In this case, the groove formed at the inner peripheral surface of the housing 1 to fix the upper plate spring 4 has an increased size, as compared to the conventional case, in order to allow another soft bond 12 to be applied in a desired amount to the upper plate spring 4 in the groove.

When a high frequency signal is applied to the voice coil 8 in the vibration speaker illustrated in FIG. 8, the vibrating plate 2 is vibrated by virtue of electromagnetic forces generated among the voice coil 8, magnet 7, and vibration coil 7*a,* so that it generates sound.

When a low frequency signal is applied to the vibration coil 7*a,* the yoke 6 moves upwardly and downwardly by virtue of electromagnetic forces generated between the vibration coil 7*a* and the magnet 7. The upward and downward movements of the yoke 6 is transmitted to the housing 1 via the plate springs 4 and 5. Thus, a desired vibration function is carried out.

The vibrating body, which is composed of the yoke 6, the magnet 7, and the weight 9, is upwardly and downwardly moved in accordance with a vibration excitement at a desired frequency using the resonant frequency of the vibrating body. Thus, vibrations are generated.

When the vibration speaker according to the present invention operates in a vibration mode, that is, when a low frequency current is applied to the vibration coil 7*a,* the plate springs 4 and 5 supporting the vibration body is damped by the damping means 10, so that the amplitude of vibrations transmitted to the vibration body is attenuated. Thus, stable vibration characteristics are outputted.

Figure 9:
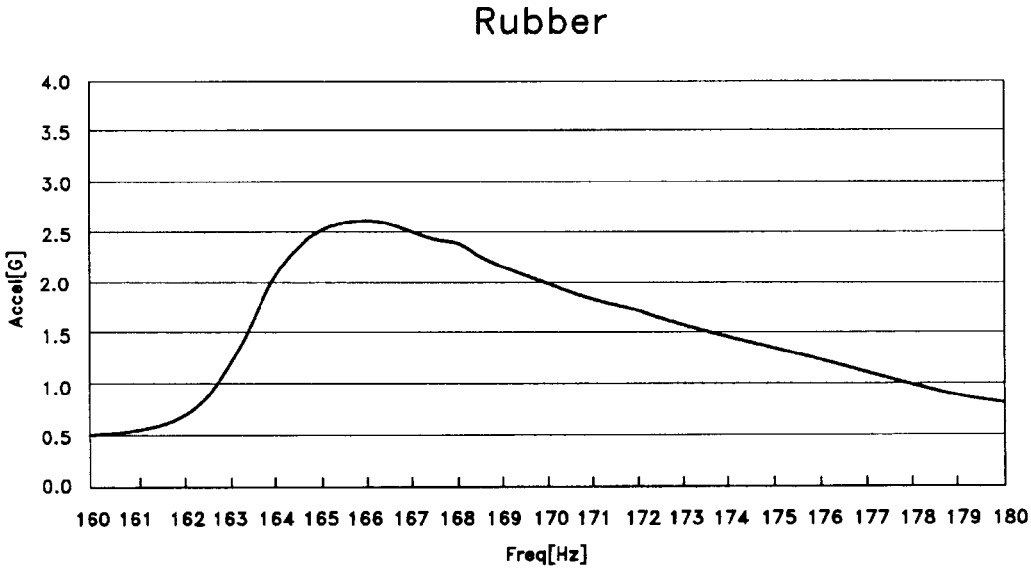
FIG. 9 is a graph depicting the vibration characteristics exhibited in the case in which plate springs are supported by a rubber member in the vibration speaker according to the present invention.

FIG. 9 is a graph depicting the vibration characteristics exhibited in the case in which the plate springs are supported by the rubber member in the vibration speaker according to the present invention.

Referring to FIG. 9, it can be found that a gentle variation in the amplitude of vibrations depending on a variation in frequency occurs because a damping force is applied to the plate springs by the damping means such as the rubber member or soft bonds.

Figure 10:
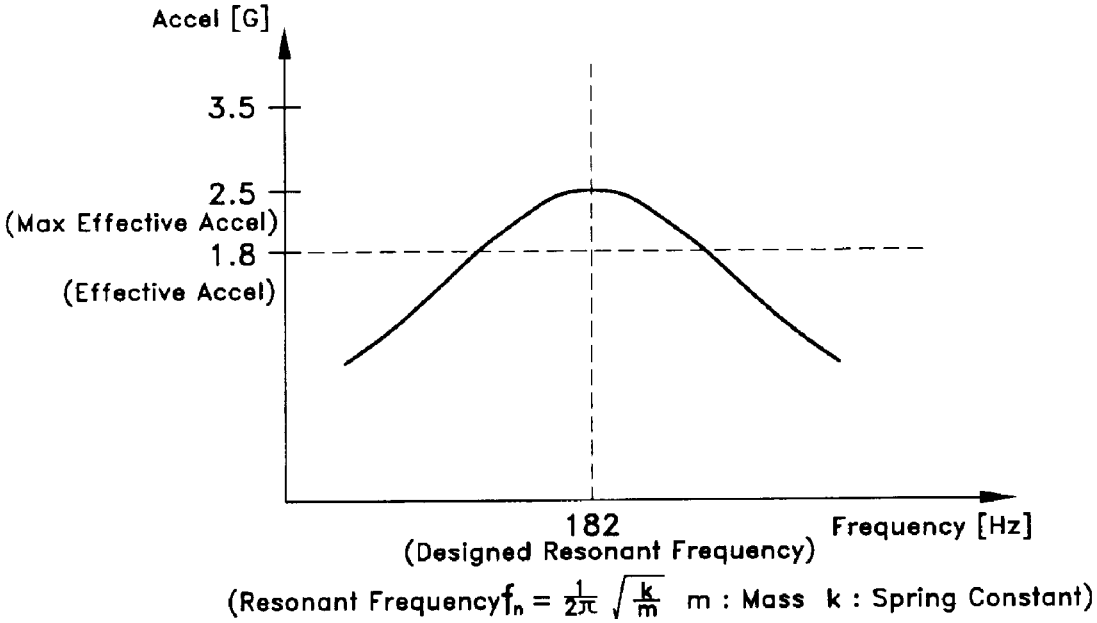
FIG. 10 is a graph illustrating the relation between the resonant frequency and the amplitude of vibrations in the vibration speaker according to the present invention.

FIG. 10 is a graph illustrating the relation between the resonant frequency and the amplitude of vibrations in the vibration speaker according to the present invention.

Referring to FIG. 10, it can be found that although the vibration body, which is composed of several elements, have a mass varying due to an assembling dispersion or dimension dispersion of those elements, it has a stable amplitude of vibrations ranging, for example, from 1.8 G to 2.5 G, because the damping means 10 serves to apply a damping force of a desired level to the plate springs 4 and 5.

In FIGS. 9 and 10, the amplitude of vibrations is referred to as "Accel".

In order to output vibrations of a desired level from the vibration speaker, it is necessary to allow the plate springs 4 and 5 to vibrate upwardly and downwardly in an elastic fashion at a low frequency of, typically, 100 to 200 Hz. In accordance with the present invention, however, the plate springs 4 and 5 receive a damping force from the damping means 10. As a result, a gentle variation in the amplitude of vibrations depending on a variation in frequency is induced, as shown in the graph.

Accordingly, an improvement in vibration characteristics and an improvement in the touch of vibrations are obtained in that the vibration body composed of the yoke 6, magnet 7, and weight 9 exhibits a stable amplitude of vibrations.

As apparent from the above description, in the vibration speaker having the above mentioned configuration according to the present invention, the damping means serves to attenuate the amplitude of vibrations transmitted to the vibrating body composed of the yoke, magnet, and weight. Accordingly, it is possible to prevent the vibration body from coming into contact with the upper and lower surfaces of the housing. It is also possible to obtain an effect of extending the bandwidth of the resonant frequency.

Although the mass of the vibrating body varies due to an assembling dispersion of the vibrating body and a dimension dispersion of the elements included in the vibrating body, the vibration amplitude variation resulting from the mass variation of the vibrating body is reduced by the damping means.

Accordingly, stable vibration characteristics are outputted. This provides an advantage in that the reliability of the product is greatly improved.

Since the vibrating body moves upwardly and downwardly within an effective vibration range, it is possible to prevent the vibrating body from coming into contact with the housing, thereby inhibiting the generation of noise and damage. Accordingly, stable vibration characteristics is ensured. In addition, there is an advantage in that the life of the product is extended.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A vibration speaker comprising:

a housing having a hollow cylindrical structure opened at both ends thereof, the housing having at one end thereof a vibrating plate adapted to generate sound and, at the other end thereof, a shield plate adapted to shield the other end of the housing;

a yoke centrally arranged in the interior of the housing and fixedly mounted to an inner peripheral surface of the housing by plate springs spaced apart from each other by a desired distance;

a magnet attached to an upper end of the yoke to have N and S poles vertically aligned together, the magnet constituting a magnetic circuit;

a voice coil having an upper end fixed to the vibrating plate, and a lower end arranged adjacent to the magnet;

a vibration coil attached to one surface of the shield plate while facing the magnet; and a damping structure arranged at the inner peripheral surface of the housing and constructed to apply a damping property to the plate springs, thereby reducing a variation in the amplitude of vibration transmitted to the plate springs, wherein the damping structure comprises more than one rubber member composed of a plurality of pieces made of a rubber material, said rubber member serving respective outer peripheral ends of the plate springs.

2. In a vibration speaker including a hollow housing open at upper and lower ends; a vibrating plate mounted to cover the upper end of the housing; a shield plate mounted to cover the lower end of the housing; a yoke located in the interior of the housing; a plate spring joined to an inner peripheral surface of the housing and to the yoke; a vertically polarized magnet mounted on the yoke; a voice coil fixed under the vibrating plate and extending downwardly adjacent to the magnet; and a vibration coil mounted on the shield plate so as to face the magnet; the improvement comprising a damping structure at the inner peripheral surface of the housing constructed to provide vibration damping to the plate spring;

further comprising a further plate spring vertically spaced from the plate spring, the damping structure being constructed to provide damping to both the plate spring and the further plate spring;

wherein the damping means comprises a rubber member composed of a plurality of pieces made of a rubber material, said rubber member serving respective outer peripheral ends of the plate springs.

* * * * *